US005488803A

United States Patent [19]

George

[11] Patent Number: 5,488,803

[45] Date of Patent: Feb. 6, 1996

[54] SASH INSERT FOR SLIDING DOOR

[75] Inventor: Gregory L. George, Valrico, Fla.

[73] Assignee: Premier Window & Door, Inc., Tampa, Fla.

[21] Appl. No.: 316,886

[22] Filed: Oct. 3, 1994

[51] Int. Cl.[6] ..... E05D 13/00

[52] U.S. Cl. ..... 49/425; 16/100

[58] Field of Search ..... 49/425, 404; 16/105, 16/97, 94 R, 100, 41

[56] References Cited

U.S. PATENT DOCUMENTS

| | | | |
|---|---|---|---|
| 1,780,755 | 11/1930 | Kurtzon . | |
| 3,033,285 | 5/1962 | Banner . | |
| 3,442,052 | 5/1969 | Levine | 49/425 |
| 3,696,560 | 10/1972 | Hallin | 49/425 |
| 3,956,854 | 5/1976 | Yamamoto . | |
| 4,404,771 | 9/1983 | Murase et al. | 49/425 |
| 4,633,615 | 1/1987 | Moose . | |
| 4,639,970 | 2/1987 | Adams . | |
| 4,956,952 | 9/1990 | Bancroft . | |
| 5,148,630 | 9/1992 | Llorens . | |

FOREIGN PATENT DOCUMENTS

| | | |
|---|---|---|
| 1496188 | 9/1967 | France . |
| 984131 | 2/1965 | United Kingdom . |

*Primary Examiner*—Kenneth J. Dorner
*Assistant Examiner*—Jerry Redman
*Attorney, Agent, or Firm*—Dowell & Dowell

[57] ABSTRACT

An insert is disclosed for use with a sliding panel door having a sash and rollers for supporting the door on a rail of a supporting frame. The insert is adapted to be secured to the sash in a vertically adjustable position and extend longitudinally between the rollers. When the sliding door is mounted on the rail, a portion of the insert surrounds the head of the rail and prevents the door from becoming dislodged from the rail by lateral forces. The insert also provides security against the sliding door being lifted and removed from the rail by an intruder. Furthermore, a weather strip can be secured to the insert to reduce air and water leakage under the door.

19 Claims, 3 Drawing Sheets

SASH INSERT FOR SLIDING DOOR

BACKGROUND OF THE INVENTION

The invention is directed to the field of sliding doors, and, more particularly, to an insert for securing to the sash of a sliding panel-type door having rollers to support the door on a rail of a supporting frame.

Sliding panel doors such as patio doors have become extremely popular for use in residential and commercial buildings. This popularity has been achieved as people have sought to have expansive areas open and accessible to the outdoors. Sliding panel doors have become particularly popular in warm climate areas where outdoors activities are enjoyed throughout the year.

Sliding doors are manufactured in a wide variety of styles, ranging from a single moving panel to multiple, parallel panels which ride on adjacent rails. Vertical members of the door panels comprise interlocking parts to reduce air and water infiltration through the door. The doors are conventionally manufactured using aluminum extrusions for framing the glass and mounting the necessary hardware for locking the panels and enabling their lateral movement.

Sliding doors are conventionally supported on a pair of rollers which ride along the rail of a door sill. Some extremely heavy sliding doors require a tandem roller assembly in which a pair of rollers are disposed at each bottom corner of the sash. The rollers are commonly vertically adjustable to raise or lower the door panels to adapt to different installation conditions.

The rollers enable almost effortless lateral movement of the sliding door during its opening and closing. The outer face of the rollers are concave to match the shape of the head of the rail. Only the weight of the doors acting downward on the rail, and contact between the rollers and the head of the rail, maintains the rollers on the rail.

The manufacturers of sliding door units must meet certain structural standards, as well as air and water infiltration standards. These standards are especially important in warmer climate regions which are subject to severe weather conditions such as hurricanes and their accompanying winds and rain. To meet these standards, manufacturers have increased the size and thickness of the framing members of the panels. Although these measures have strengthened the sliding doors, the increased size of the framing members has decreased the aesthetic value of the units.

In addition to the doors requiring adequate strength, it is also essential that the rollers remain on their rails even in high winds, to prevent air and water leakage. A conventional rail has a width of about 0.188", and a conventional roller has an outer diameter of 1.500" and an inner diameter of 1.260". Accordingly, there is a concavity of less than ⅛" (0.120") on the concave face of the rollers and the rollers can be easily dislodged from rails by high winds. In fact, most of the known units fail in testing because the panels are easily dislodged from their rails by high winds, which allows unacceptable levels of air and water leakage past the panels.

Another problem with the known roller systems used in sliding door units is that the rollers provide little security against an intruder simply using a tool to lift the panel off its track to gain access to the property. To prevent such occurrences, sliding door units have incorporated dead bolts and various types of stops to prevent the panels from being moved laterally. Although being of some limited success, these measures have been ineffective in units having two moving panels.

Another protective measure has been to drill aligned holes through the door header and the panel header and insert a dead bolt through the holes to prevent the door from being lifted from the rail. This approach has been unsatisfactory because the dead bolt can be as much as eight feet above the floor and it must be reinserted each time the unit is secured. A further disadvantage of using a dead bolt is that once the panel height is adjusted, the holes in the door and panel headers often become misaligned.

SUMMARY OF THE INVENTION

The present invention has been made in view of the above-described inadequacies of the known sliding doors and has as an object to provide an insert which can be secured to a sash of a newly installed or existing sliding door to prevent the door from becoming dislodged from a rail even by large lateral forces.

Another object of the invention is to provide an insert assembly including a weather strip, which can be secured to a sash of a sliding door to prevent air and water leakage under the door even in heavy winds and rains.

A further object of the invention is to provide an insert which can be secured to a sash of a sliding door to provide security against an intruder lifting the door and removing it from the rail to gain access to a building.

A still further object of the invention is to provide an insert which can be secured to the sash of a sliding door in a vertically adjustable position to adapt to variable installation conditions.

Additional objects and advantages of the present invention will become apparent from the description which follows, considered in conjunction with the accompanying drawing figures, or by practice of the invention.

To achieve the objects of the invention, as embodied and broadly described herein, the insert in accordance with a preferred embodiment of the invention is suitable for use with a sliding door which comprises a sash having opposed longitudinal sidewalls and a pair of rollers mounted to the longitudinal sidewalls at opposite ends of the sash to support the sliding door on an upstanding rail.

The insert comprises a pair of opposed longitudinal sidewalls which are adapted to be received in and secured to the longitudinal sidewalls of the sash. At least one of the longitudinal sidewalls of the insert includes means for vertically adjusting the insert relative to the sash. The longitudinal sidewalls of the insert each have an inwardly inclined terminal portion at a lower end thereof. The terminal portions are spaced with respect to each other and define a longitudinal opening therebetween having a width greater than the width of the rail.

DETAILED DESCRIPTION OF THE PREFERRED EMBODIMENT

Figure 1:
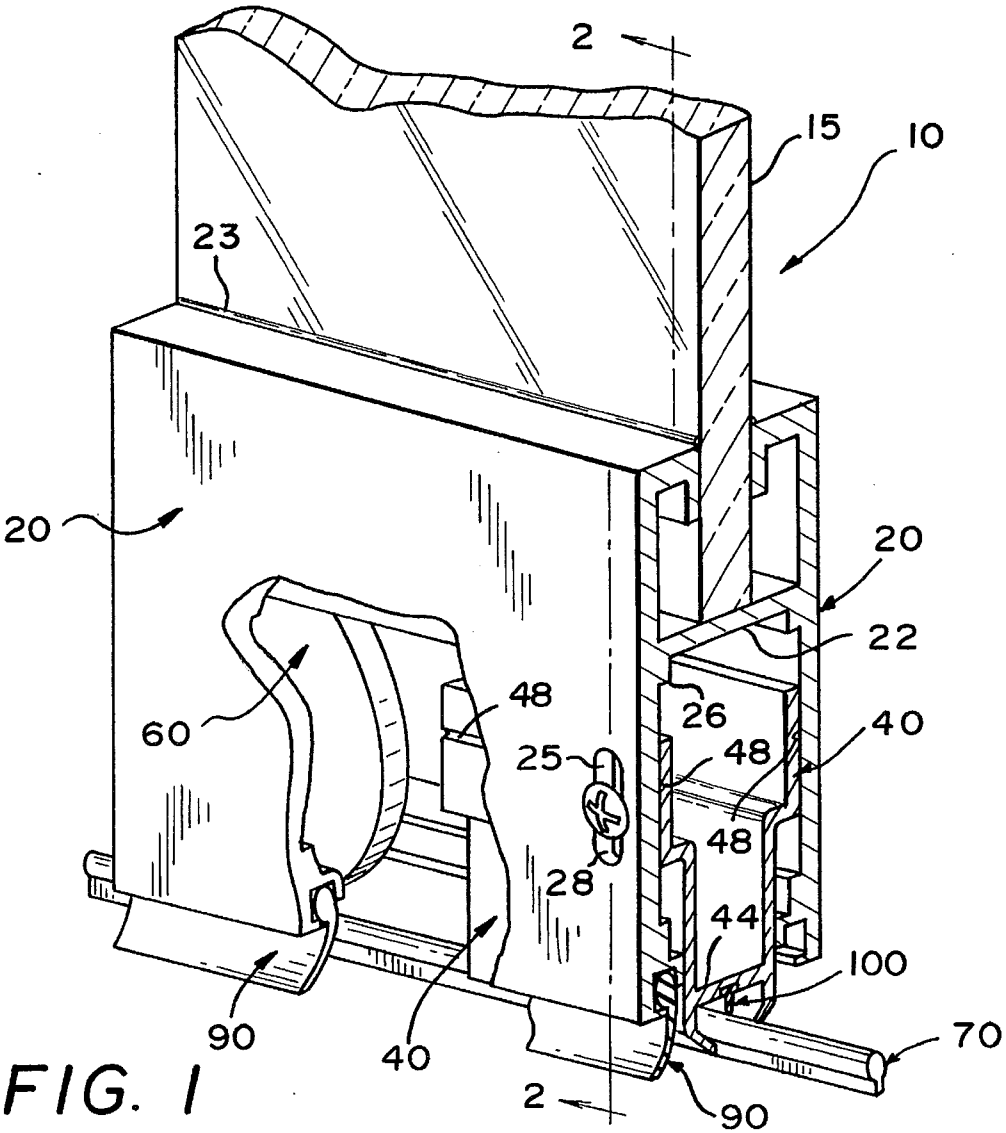
FIG. 1 is a partially broken-away isometric view of a sliding door unit, including a sash and an insert in accordance with a preferred embodiment of the invention, mounted on a rail.
Figure 2:
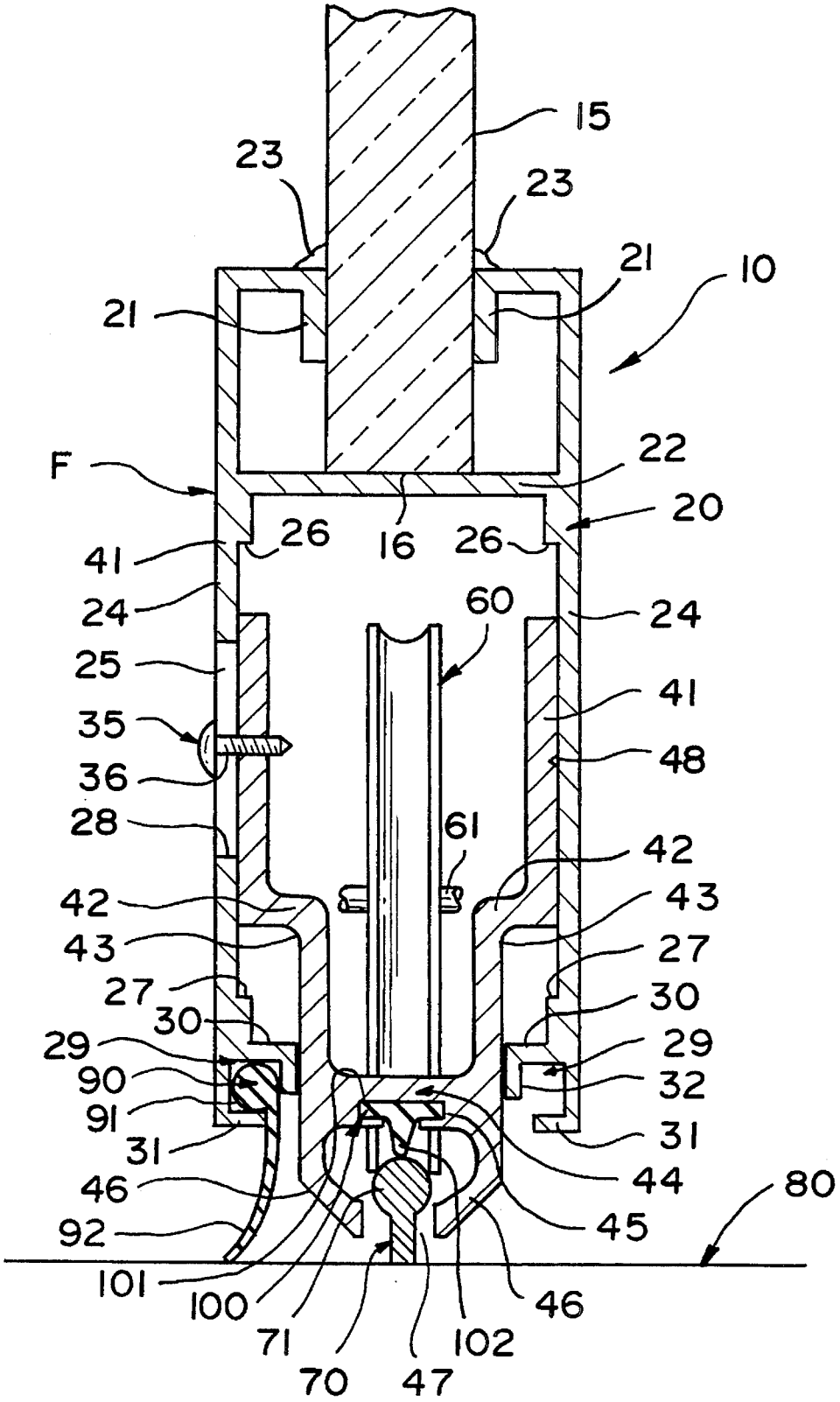
FIG. 2 is a cross-sectional, side elevational view in the direction of line 2—2 of the sliding door unit of FIG. 1.

FIGS. 1 and 2 illustrate a sliding door unit 10 which comprises a sash 20, and a pair of rollers 60 (FIG. 4) having pivot axes 61 mounted to the sash 20 adjacent to its opposite bottom corners. The sash forms the bottom frame portion of the sliding door. The rollers 60 support the sliding door on a rail 70 which extends upwardly from a door sill 80 of the supporting frame. The remainder of the supporting frame, which includes the upper header and opposed jambs, is not shown in the drawing figures.

Conventionally, the sliding door unit 10 includes a second, parallel sliding door which rides on an adjacent rail (not shown).

The illustrated sliding door 10 includes a panel 15 of a transparent material such as glass. The panel may optionally be a wood, metal or metal screen material. The bottom portion of the panel 15 is mounted in a channel formed between opposed walls 21 of the sash and the bottom face 16 of the panel rests on a supporting wall 22. A glazing material 23 is applied along both sides of the panel to form a watertight seal.

Figure 4:
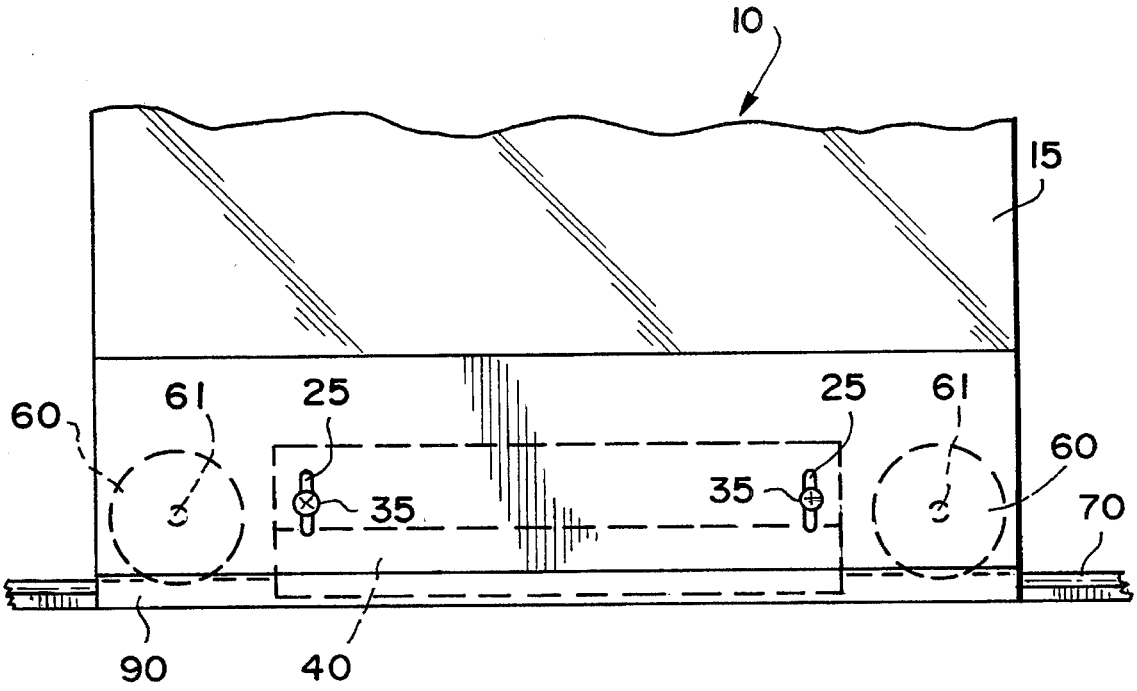
FIG. 4 is a side elevational view of the sliding door unit of FIG. 1 illustrating in dotted line the position of the insert relative to the rollers.

The sash 20 has an elongated structure and includes opposed longitudinal sidewalls 24. As illustrated, an insert 40 in accordance with a preferred embodiment of the invention is secured to the sash. The insert 40 has an elongated, hollow structure. The insert comprises a pair of opposed vertical upper sidewalls 41 which are spaced from each other such that the insert fits snugly within the sash. Referring to FIG. 4, the insert has a length such that it extends substantially between the rollers 60 mounted to the sash 20 at its opposite ends. As illustrated in FIG. 1, the end of the insert 40 is close to the roller 60 when the insert is secured to the sash.

The insert further comprises a horizontal upper connecting wall 42 which connects the upper vertical sidewalls 41 to vertical lower sidewalls 43. As illustrated, the lower sidewalls 43 are inwardly spaced relative to the upper sidewalls 41. A horizontal lower connecting wall 44 connects the lower sidewalls 43. A horizontal longitudinal channel 45 is formed in the bottom face of the connecting wall 44 and extends the length of the insert 40. The channel 45 is open at both ends of the insert and is provided to receive a weather strip 100 as will be described in greater detail below. The lower sidewalls 43 terminate at their lower ends at inwardly inclined terminal portions 46. The terminal portions 46 are spaced from each other and define a longitudinal opening 47 therebetween. The opening 47 has a sufficient width to receive the circular head portion 71 of the rail 70 of the sliding door.

The insert 40 is preferably formed as an extrusion of an aluminum-based material. The insert may optionally be composed of other suitable lightweight materials.

The insert 40 is vertically adjustable relative to the sash 20. With reference to FIGS. 1, and FIG. 4 a vertical slot 25 is formed in the interior sidewall 24 of the sash adjacent to each end of the insert. The vertical slots are formed on the interior sidewall because adjustments are made on this side of the door to prevent intruders from raising the insert.

Figure 3:
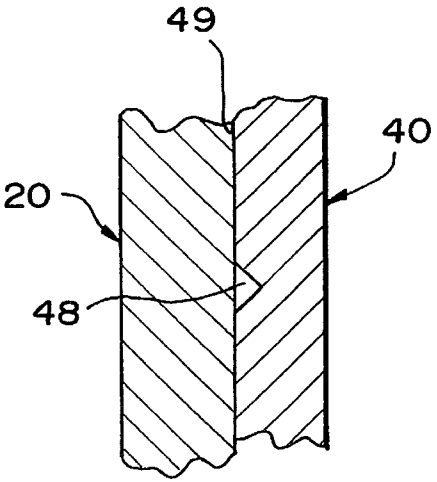
FIG. 3 is an enlarged view along the plane of the cross-section in FIG. 1, illustrating the preferred configuration of a notch formed in a longitudinal sidewall of the insert.

With reference to FIGS. 1 and 3, a horizontal notch 48 is preferably formed in the outer surface 49 of each of the vertical upper sidewalls 41 of the insert 40 to facilitate vertical adjustment of the insert relative to the sash 20. By forming the notches on both sides of the insert 40, the insert cannot be installed backward and a notch always faces the interior sidewall of the sash and is accessible through the vertical slots 25. The notches 48 are preferably sized to receive the head of a tool such as a flat head screwdriver (not shown) to vertically adjust the position of the insert.

The manner of use of the insert in accordance with the preferred embodiment of the invention will now be described. The insert 40 is initially fitted within the sash 20 such that the outer surfaces 49 of the upper sidewalls 41 of the insert abut the sidewalls 24 of the sash and the insert extends substantially between the rollers 60. In this position, the insert is snugly retained by the sash.

The upper end (not shown) of the door panel 15 is inserted in the door header (not shown) and the rollers 60 are positioned on the head 71 of the rail 70. The rollers 60 are then vertically adjusted as necessary to level the panel and align it with other panels of the unit.

Next, the insert 40 is vertically adjusted relative to the sash. The vertical position of the insert is first adjusted at one end of the sash. Using a suitable tool to engage the notch 48, the insert is adjusted such that the terminal portions 46 of the insert surround the head 71 of the rail 70 as depicted in FIG. 2. The range of vertical adjustability of the insert is limited by the spaced horizontal shoulders 26 and 27 of the sash.

Once one end of the insert is properly adjusted, the notch 48 in the interior upper sidewall 41 of the insert 40 is visible through the slots 25 formed in the adjacent sidewall 24 of the sash. The distance from the notch 48 to the bottom surface 28 of the respective slot is measured or visually estimated. Using this distance as a reference, the insert 40 is vertically adjusted at its opposite end to ensure that it is level relative to the sill 80, and that the terminal portions 46 of the insert surround the head 71 of the rail 70 along the length of the insert.

In accordance with the invention, means are provided for fixedly securing the insert 40 to the sash 20 in its vertically adjusted position. The securing means are preferably self-drilling and tapping fasteners 35. The fasteners have a diameter smaller than the width of the slot 25 to enable vertical readjustment as necessary, and the fastener heads 36 have a diameter larger than the slot width. The fasteners are driven through the slots and through the vertical upper sidewall 41 of the insert to secure the insert to the sash.

It will be understood by those skilled in the art that the insert in accordance with the invention may also be retrofitted to existing doors. In such instances, the sashes lack preformed elongated vertical slots, and the fasteners are driven through the sidewalls of the sash and insert to secure the insert in an adjusted position. Optionally, the insert may be secured to the sash by suitable clips and the like, without having to form holes through either the sash or insert.

Once the insert 40 is fixedly secured to the sash 20, the insert prevents the rollers 60 from becoming dislodged from the head 71 of the rail when the sliding door is subjected even to large lateral forces. With reference to FIG. 1, when a lateral force represented by arrow "F" acts on the sliding door unit 10, the sliding door moves in the direction of the lateral force. The possible range of movement of the sliding door is limited, however, by the insert. That is, after the sliding door moves a small distance, an inwardly oriented terminal portion 46 contacts the rail and prevents further lateral movement of the sliding door. This small amount of movement of the sliding door is insufficient to dislodge the rollers 60 from the rail 70 and, after the lateral force is removed, the door resumes its original position.

Furthermore, because the insert 40 is continuous and extends along the length of the sash 20 substantially between the rollers 60, the insert contacts the rail 70 over most of the length of the sash when a large lateral force is applied to the sliding door. This contact renders it almost impossible for the lateral force to dislodge the sliding door from the rail.

The insert 40 in accordance with the invention also provides security against an intruder attempting to lift and remove the sliding door from its associated rail. That is, the insert effectively increases the height of the sliding door and makes it physically impossible to remove the sliding door without first raising the insert relative to the sash. With the insert attached to the sliding door in its adjusted position, there is inadequate clearance above the sliding door to be able to lift the inwardly oriented terminal portions 46 above the head 71 of the rail 70 and remove the sliding door.

Another advantage of the insert is that it increases the structural strength of the sash by providing lateral support. Moreover, because the insert is formed of a lightweight material, it contributes little additional weight to the sliding door.

To provide protection against air and water leakage under the sliding door, the sash 20 is preferably constructed to receive a weather strip 90 which extends along substantially the entire length of the sash. As illustrated in FIG. 1, the weather strip 90 includes a bead portion 91 which is received in a horizontal channel 29 of the sash 20, and a flexible strip portion 92 which contacts the sill 80. A channel 29 is formed at both sides of the sash between a sidewall 24, spaced horizontal walls 30, 31, and a vertical wall 32 spaced inward from the sidewall 24. As illustrated, the vertical walls 32 preferably abut the lower vertical sidewalls 43 of the insert for increased support.

The horizontal channel 45 of the insert 40 is constructed to receive a slidable second weather strip 100 which provides a barrier to any air and water which passes under the weather strip 90 secured to the sash 20. As illustrated in FIG. 1, the second weather strip 100 includes a base portion 101 which is slidably received in the channel 45, and a downward depending strip portion 102 which contacts the head 71 of the rail 70. Any air or water which passes under the weatherstrip 90 is inhibited from traveling over and around the rail by the strip portion 102 of the second weather strip 100. Furthermore, the weather strip 100 remains fully effective even when the height of the panel is adjusted, because the distance between the insert and rail remains constant.

The first weather strip 90 is preferably composed of a flexible vinyl material or the like. The second weather strip 100 is preferably composed of a plastic material having a pile material on the outer surface of the strip portion 102.

It will be understood by those skilled in the art that the insert in accordance with the invention may be used with other types of sliding enclosures such as horizontal sliding windows.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims, and their equivalents.

What is claimed is:

1. An insert for use with a sliding door including a sash having opposed longitudinal sidewalls and a pair of rollers mounted to the longitudinal sidewalls of the sash to support the sliding door on an upstanding rail, the insert comprising a pair of opposed longitudinal sidewalls adapted to be received within and secured to the longitudinal sidewalls of the sash, one of the longitudinal sidewalls of the insert including means for vertically adjusting the position of the insert relative to the sash, means for retaining said insert in a vertically adjusted position during operation of the sliding door, the longitudinal sidewalls of the insert each having an inwardly inclined terminal portion at a lower end portion thereof, the terminal portions being spaced from each other and defining a longitudinal opening therebetween having a width greater than the width of the rail.

2. The insert of claim 1, wherein the adjusting means comprises a longitudinal notch formed in an outer surface of one of said opposed longitudinal sidewalls of said insert.

3. The insert of claim 2, wherein the insert has a length such that it extends substantially between the rollers when secured to the longitudinal sidewalls of the sash, and has a width such that the opposed longitudinal sidewalls of the insert each abut a respective longitudinal sidewall of the sash when received therein.

4. The insert of claim 3, further comprising a connecting wall which extends between the opposed longitudinal sidewalls, said connecting wall defines a longitudinal channel which is adapted to slidably receive a weather strip.

5. The insert of claim 4, being composed of an aluminum-based material.

6. The insert of claim 1, wherein the adjusting means comprises a longitudinal notch formed in an outer surface of each of said opposed longitudinal sidewalls of said insert.

7. An insert assembly for use with a sliding door including a sash having opposed longitudinal sidewalls and a pair of rollers mounted to the longitudinal sidewalls at opposite ends of the sash to support the sliding door on an upstanding rail, the insert assembly comprising a pair of opposed longitudinal upper sidewalls adapted to be received within and secured to the longitudinal sidewalls of the sash, the insert having a length such that it extends substantially between the rollers when secured to the longitudinal sidewalls of the sash and the insert having a width such that the opposed longitudinal upper sidewalls of the insert each abut a respective longitudinal sidewall of the sash when received therein, one of the longitudinal upper sidewalls of the insert having a longitudinal notch formed in its outer surface, a pair of opposed longitudinal lower sidewalls each of which is integral with a respective longitudinal upper sidewall and inwardly spaced relative thereto, the longitudinal lower sidewalls each having an inwardly inclined terminal portion forming a lower end portion thereof, the terminal portions being spaced from each other and defining a longitudinal opening therebetween having a width greater than the width of the rail, a connecting wall extending between the opposed longitudinal lower sidewalls of the insert and defining a longitudinal channel, and a weather strip being slidably received in said longitudinal channel.

8. The insert assembly of claim 7, being composed of an aluminum-based material.

9. The insert assembly of claim 7, wherein each of the longitudinal upper sidewalls of the insert has a notch formed in its outer surface.

10. A sash assembly for use with a sliding door, comprising:

a sash including a pair of opposed longitudinal sidewalls;

a pair of rollers mounted to the longitudinal sidewalls of the sash to support the sliding door on an upstanding rail disposed on a sill;

an insert comprising a pair of opposed longitudinal sidewalls adapted to be received within and secured to the longitudinal sidewalls of the sash such that the longitudinal sidewalls of said insert extend substantially between the rollers, the longitudinal sidewalls of said insert each having an inwardly inclined terminal portion forming a lower end portion thereof, the terminal portions being spaced from each other and defining a longitudinal opening therebetween having a width greater than the width of the rail; and means for vertically adjusting said insert relative to said sash such that the terminal portions of said insert surround a portion of the rail so as to limit lateral movement of the sliding door on the rail and prevent the sliding door from being lifted from the rail.

11. The sash assembly of claim 10, wherein said opposed longitudinal sidewalls of said insert each comprise an upper longitudinal sidewall, the upper longitudinal sidewalls being spaced from each other such that each upper longitudinal sidewall abuts a respective longitudinal sidewall of said sash when said insert is received within said sash, the adjusting means comprises a longitudinal notch formed in an outer surface of one of the upper longitudinal sidewalls and a pair of longitudinally spaced vertical slots which extend through one of the longitudinal sidewalls of said sash, the longitudinal notch being visible through the vertical slots when said insert is received with said sash.

12. The sash assembly of claim 11, wherein a longitudinal notch is formed in an outer surface of each of the upper longitudinal sidewalls of said insert.

13. The sash assembly of claim 11, further comprising means for fixedly securing said insert to said sash in the adjusted position.

14. The sash assembly of claim 13, wherein said sash further comprises means for limiting vertical adjustability of the insert relative to said sash.

15. The sash assembly of claim 14, wherein said sash further comprises a first longitudinal channel disposed at a bottom end of said one of the longitudinal sidewalls of said sash.

16. The sash assembly of claim 15, further comprising a first weather strip which is slidably received in said first longitudinal channel, said first weather strip has a length substantially equal to the length of said sash and a height such that said first weather strip contacts the sill when the rollers of the sliding door are positioned on the rail.

17. The sash assembly of claim 16, wherein said opposed longitudinal sidewalls of said insert each further comprise a lower longitudinal sidewall spaced inwardly relative to the upper longitudinal sidewall and said first longitudinal channel, and a connecting wall extends between said lower longitudinal sidewalls and defines a second longitudinal channel which extends along the length and is open at opposed ends of said insert.

18. The sash assembly of claim 17, further comprising a second weather strip which is slidably received in said second longitudinal channel, said second weather strip has a length substantially equal to the length of said insert and a height such that it contacts the rail when said insert is in the adjusted position.

19. The sash assembly of claim 10, wherein said insert is composed of an aluminum-based material.

* * * * *